US007543401B2

(12) United States Patent
Hughes

(10) Patent No.: US 7,543,401 B2
(45) Date of Patent: Jun. 9, 2009

(54) BACK DRAG PLOW

(75) Inventor: Doug Hughes, 1470 Sunset Dr. SW., Owatonna, MN (US) 55060

(73) Assignee: Doug Hughes, Owatonna, MN (US)

( * ) Notice: Subject to any disclaimer, the term of this patent is extended or adjusted under 35 U.S.C. 154(b) by 0 days.

(21) Appl. No.: 11/893,959

(22) Filed: Aug. 17, 2007

(65) Prior Publication Data

US 2009/0044433 A1 Feb. 19, 2009

(51) Int. Cl.
*E01H 5/06* (2006.01)

(52) U.S. Cl. ..... 37/232; 37/268; 37/903; 37/233

(58) Field of Classification Search ..... 37/268, 37/903, 232, 233
See application file for complete search history.

(56) References Cited

U.S. PATENT DOCUMENTS 1,856,148 A * 5/1932 Ball ..... 172/136
2,657,481 A * 11/1953 Larsen ..... 37/444
2,774,155 A 12/1956 Hipp
3,311,175 A 3/1967 Richey
3,793,752 A * 2/1974 Snyder ..... 37/234
3,808,714 A * 5/1974 Reissinger et al. ..... 37/233
4,008,771 A * 2/1977 Tomio ..... 172/815
4,255,878 A * 3/1981 Mahler et al. ..... 37/232
4,259,794 A * 4/1981 Rath ..... 37/233
4,261,115 A * 4/1981 Chittenden ..... 37/268
4,307,523 A * 12/1981 Reissinger et al. ..... 37/233
4,635,387 A 1/1987 Haring
4,709,492 A 12/1987 Watson
5,140,763 A * 8/1992 Nichols, IV ..... 37/233
5,437,113 A * 8/1995 Jones ..... 37/233
5,595,007 A 1/1997 Biance
6,073,371 A 6/2000 Goos et al.
6,314,666 B1 * 11/2001 Klemenhagen et al. ..... 37/267
6,470,604 B1 10/2002 Foster et al.
6,578,890 B1 * 6/2003 Gilmore et al. ..... 294/54.5
6,618,965 B1 9/2003 Schultz et al.
6,701,646 B2 3/2004 Schultz et al.
6,860,039 B2 3/2005 Schultz et al.
6,860,040 B2 3/2005 Schultz et al.
7,171,770 B2 * 2/2007 Schultz et al. ..... 37/232

* cited by examiner

*Primary Examiner*—Thomas A Beach
*Assistant Examiner*—Matthew R Buck
(74) *Attorney, Agent, or Firm*—Leffert Jay & Polglaze, P.A.

(57) ABSTRACT

A plow has an upper blade. A lower forward-plowing blade is coupled to the upper blade. The lower forward-plowing blade is configured to engage material to be plowed when the plow is plowing in a forward direction. A back-blade is pivotally coupled to the upper blade and elastically coupled to the upper blade. The back-blade is configured to engage material to be plowed when the plow is plowing in a reverse direction opposite the forward direction.

32 Claims, 6 Drawing Sheets

BACK DRAG PLOW

FIELD

The present disclosure relates generally to plows and in particular the present disclosure relates to back drag plows.

BACKGROUND

Plow blades are generally designed to plow material, such as snow, e.g., while the plow vehicle is moving forward. For example, snow plow blades are typically designed to push snow. However, in many applications, the snow must be pulled away from obstacles, such as a garage in some home driveway applications, curbs, parking lot islands, loading docks, etc. In these applications, where snow must be pulled from tight areas, the plow vehicle first must drive over the snow in order to get in position to lower the plow and start back dragging the snow away. This packs the snow into hard-packed icy snow and sticks it to the surface with the weight of the plow vehicle. While pulling the snow backwards, the plow vehicle now moving in reverse again drives back over the snow a second time, packing down the snow in the process even more. When the plow vehicle is moving in reverse, a normal snow plow blade that is curved, e.g., concave forward, for forward plowing now floats over the snow, e.g., typically leaving about 1 inch to about 2 inches of snow that can not be removed from the surface being plowed. Therefore, various back-blade configurations have been implemented for improving snow plowing in reverse.

Plow blades designed for forward plowing often include a trip mechanism that allows a bottom portion of the plow blade, e.g., or the entire plow blade when pushing snow while plowing in the forward direction, to be deflected or tripped when the plow blade hits a permanent object like a manhole, curb, etc. However, plow blades designed for forward plowing are normally not configured to be tripped when the blade hits a permanent object when plowing in reverse. Moreover, the various back-blade configurations designed for plowing in reverse are usually not configured to be tripped when the blade hits an object when plowing in reverse.

For the reasons stated above, and for other reasons stated below which will become apparent to those skilled in the art upon reading and understanding the present specification, there is a need in the art for alternative plow blades.

SUMMARY

Figure 1:
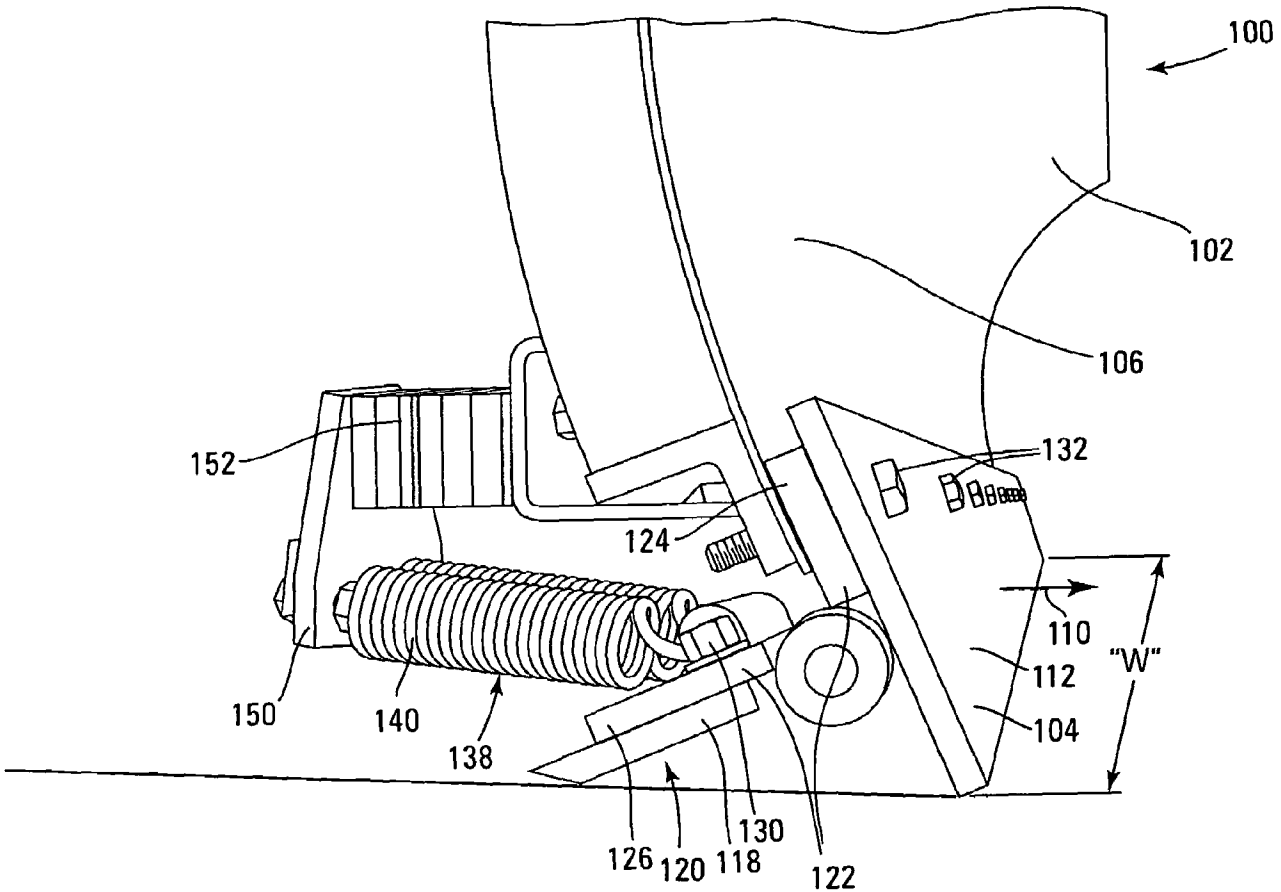
FIG. 1 illustrates front and side portions of an embodiment of a plow, according to an embodiment of the disclosure.

One embodiment of the disclosure provides a plow having an upper blade. A lower forward-plowing blade is coupled to the upper blade. The lower forward-plowing blade is configured to engage material to be plowed when the plow is plowing in a forward direction. A back-blade is pivotally coupled to the upper blade and elastically coupled to the upper blade. The back-blade is configured to engage material to be plowed when the plow is plowing in a reverse direction opposite the forward direction.

DETAILED DESCRIPTION

In the following detailed description, reference is made to the accompanying drawings that form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present disclosure. The following detailed description is, therefore, not to be taken in a limiting sense, and the scope of the present disclosure is defined only by the appended claims and equivalents thereof.

Figure 2:
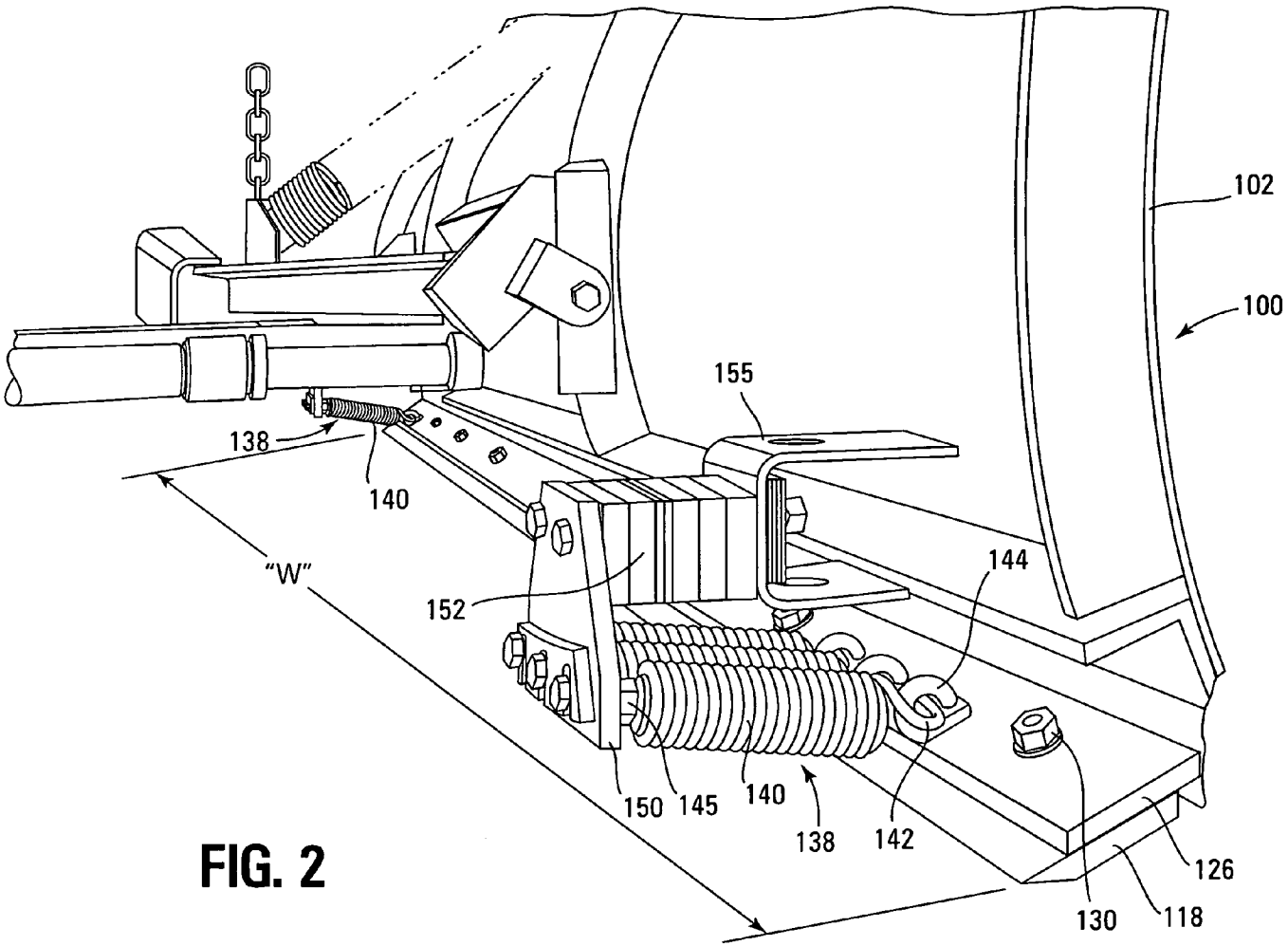
FIG. 2 illustrates a rear portion of an embodiment of a plow, according to another embodiment of the disclosure.

FIG. 1 illustrates front and side portions of plow 100, such as a snowplow, according to an embodiment. FIG. 2 illustrates a rear portion of plow 100, according to another embodiment. For one embodiment, plow 100 includes an upper blade 102, e.g., a moldboard, and a lower forward-plowing blade 104, such as a wear blade, that is fixedly coupled to upper blade 102, e.g., by bolting, as shown in FIG. 1. Upper blade 102 has a curved forward surface 106 that is curved concave forward, e.g., concave in the direction of motion of the plow vehicle during normal forward plowing as indicated by arrow 110 in FIG. 1. Lower blade 104 has a forward surface 112 that extends forward surface 106 of upper blade 102. During forward plowing, in the direction of arrow 110, lower blade picks up the material being plowed, such as snow, dirt, etc., and directs the material to upper blade 102, which directs the material off to a side of plow 100.

For one embodiment, plow 100 includes a back-blade 118, e.g., as a portion of a back-drag system 120, that is pivotally coupled to plow 100, as shown in FIG. 1. For example, a hinge 122, e.g., a strap hinge, of back-drag system 120 may pivotally couple back-blade 118 to plow 100, as shown in FIG. 1. For some embodiments, back blade 118 may be of hardened steel to reduce wear.

For one embodiment, back-blade 118 spans an entire width W of upper blade 102 so that back-blade 118 is as long as the plow 100 is wide, as shown in FIG. 2. Moreover, forward-plowing blade 104 may span the entire width W of upper blade 102 so that forward-plowing blade 104 is as long as the plow 100 is wide, as shown in FIG. 1, meaning that forward-plowing blade 104 and back-blade 118 may substantially the same lengths in a direction along the width of upper blade 102 and plow 100.

Figure 3:
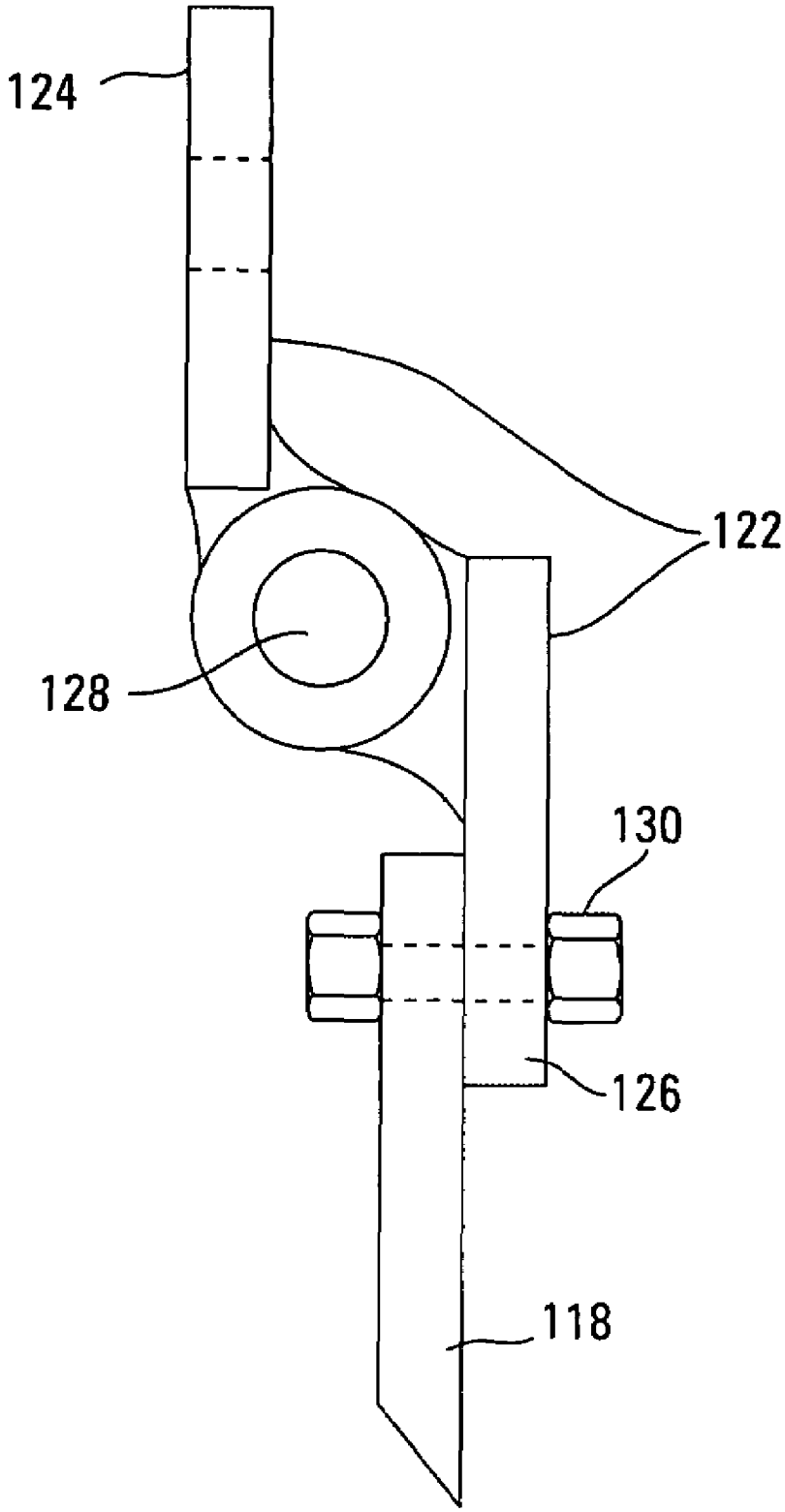
FIG. 3 illustrates a hinge coupled to a back-blade of a plow, according to another embodiment of the disclosure.

FIG. 3 illustrates hinge 122 coupled to back-blade 118, according to another embodiment. For one embodiment, hinge 122 has a strap (or plate) 124 rotatably coupled to a strap (or plate) 126 by a pin 128. Back-blade 118 is coupled to strap 126, e.g., by bolting using bolts 130, as shown in FIGS. 1-3. Strap 124 is coupled to plow 100, e.g., by bolting using bolts 132. When strap 124 is coupled to plow 100, strap 124 is fixed to plow 100 so that it cannot move relative to plow 100, and strap 126, and thus back blade 118, can pivot with respect to plow 100. For one embodiment, strap 124 is interposed between lower blade 104 and upper blade 102 adjacent a bottom edge of upper blade 102, as shown in FIG. 1.

Back-drag system 120 includes one or more biasing systems 138, including one or more biasing elements, such as one or more springs 140, as shown in FIGS. 1 and 2. For example, a biasing system 138 may be located adjacent each end of plow 100, as shown in FIG. 2.

For one embodiment, each spring 140 of each biasing system 138 elastically couples strap 126, and thus back blade 118, to a portion of plow 100, e.g., to a rear portion of upper blade 102, as shown in FIGS. 1 and 2. Each spring 140 may include a hook 142 at an end thereof. Passing hook 142 through an eyelet 144 on strap 126 couples each spring 140 to strap 126 for one embodiment, as shown in FIG. 2.

An end 145 of each spring 140 that is opposite the end of that spring 140 that is coupled to strap 126, e.g., that is opposite the hook 142 of that spring 140, is coupled to the rear portion of upper blade 102. For example, a plate 150 of each biasing system 138 may couple the end 145 of each spring 140 to the rear portion of upper blade 102, as shown in FIGS. 1 and 2. For one embodiment, plate 150 may be coupled to a protrusion 155 that extends from the rear portion of upper blade 102 to accommodate the length of each spring 140, as shown in FIG. 2. For another embodiment, one or more spacers 152 of each biasing system 138 may be interposed between the rear portion of upper blade 102 and plate 150 or between plate 150 and an end of protrusion 155, e.g., as shown in FIGS. 1 and 2, to accommodate the length of each spring 140. Note that the configuration of the spacers may vary from that shown in FIGS. 1 and 2.

The one or more biasing systems 138 bias back-drag system 120 into the forward-plowing blade configuration of plow 100 of FIG. 1. That is, the one or more biasing systems 138 bias back blade 118 into the position shown in FIG. 1. Moreover, the one or more biasing systems 138 elastically couple strap 126 of hinge 122, and thus back blade 118, to a portion, e.g., the rear portion, of upper blade 102 so that back blade 118 can pivot with respect upper blade 102 against the elastic force provided by the one or more biasing systems 138.

For one embodiment, back-drag system 120 is configured to be added to a conventional or stock plow, as received from the factory and configured for forward plowing, without making modifications to the stock plow. That is, back-drag system 120 is backward compatible with a stock plow as received from the factory. For one embodiment, upper blade 102 and lower forward-plowing blade 104 constitute part of the stock plow.

Back-drag system 120 may be secured to a stock plow, e.g., by bolting, with no drilling, welding, cutting, or modifications to the stock plow. For one embodiment, back-drag system 120 may be secured to the stock plow by interposing strap 124 of hinge 122 between upper blade 102 and lower forward-plowing blade 104 and subsequently passing the bolts through existing bolt holes in upper blade 102 and in lower forward-plowing blade 104, as shown in FIG. 1, originally used for bolting lower forward-plowing blade 104 to upper blade 102 when there was no back-drag system 120. Note that the existing bolt holes in upper blade 102 and in lower forward-plowing blade 104 were formed in the factory and were present when the stock plow was received from the factory. Note further that the pattern of the bolt holes in strap 124 matches the pattern of the bolt holes in the lower forward-plowing blade 104 and the pattern of the bolt holes in upper blade 102.

Moreover, biasing system 138 may be bolted to the rear of upper blade 102, as shown in FIG. 1. Note that for one embodiment, biasing system 138 may be attached by bolts or other attachment methods to protrusion 155 (as shown in FIG. 2) that is a part of the stock plow as received from the factory. Also note that one or more spacers or other adjustable methods 152 are part of back-drag system 120 and may be used to help accommodate the length of springs 140, as discussed above in conjunction with FIG. 2.

Figure 4:
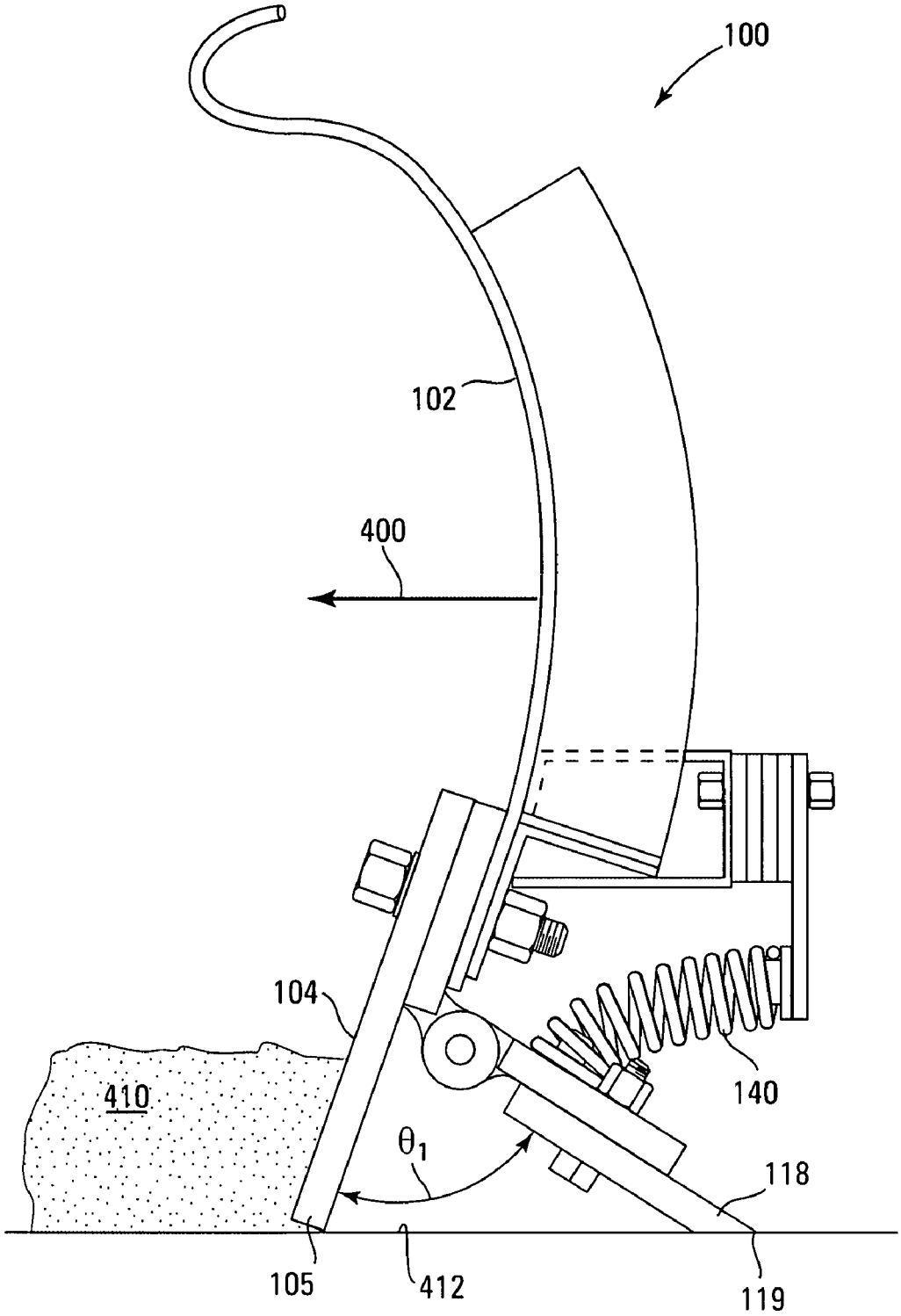
FIG. 4 is a side view of a plow during forward plowing, according to another embodiment of the disclosure.

FIG. 4 is a side view of the forward-plowing blade configuration during operation, according to another embodiment, where plow is moving in the direction of arrow 400 and is plowing a material, such as snow 410, e.g., in a normal forward direction. For one embodiment, while plowing with plow 100 in the forward-plowing blade configuration, substantially the entire weight of plow 100 is directed onto lower forward-plowing blade 104. For example, a bottom edge 105 of lower blade 104 that is in contact with a surface 412 being plowed supports substantially the entire weight of plow 100.

For another embodiment, as plow 100 plows in the forward direction with lower blade 104 moving in contact with surface 412 against snow 410, back-blade 118 is biased, e.g., by one or more springs 140 of biasing system 138, so that a bottom edge 119 of back-blade 118 rides in contact with surface 412, e.g., substantially "floats" over surface 412, while exerting substantially little or no force, relative to the weight of blade 100, on surface 412. For other embodiments, a small gap (not shown) may separate bottom edge 119 of back-blade 118 from surface 412 during forward plowing.

For one embodiment, as plow 100 plows in the forward direction, lower forward-plowing blade 104 is angled toward the direction of forward plowing, and back-blade 118 may be angled away from the direction of forward plowing toward the rear of plow 100, as shown in FIG. 4. For example, during forward plowing, back-blade 118 may be angled away from lower forward-plowing blade 104 by an angle $\theta_1$, with respect to lower forward-plowing blade 104, in the direction toward the rear of plow 100, as shown in FIG. 4.

Figure 5:
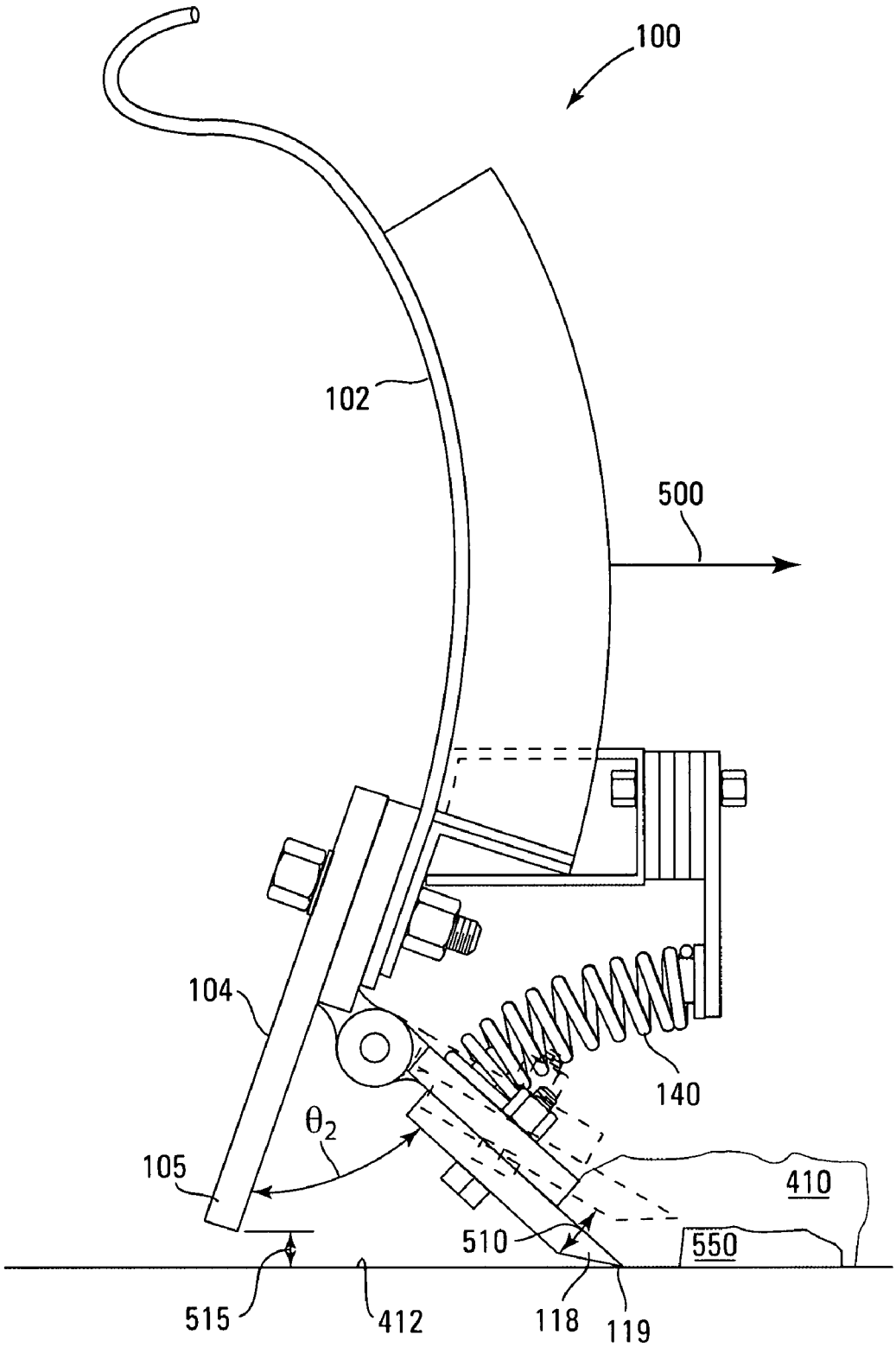
FIG. 5 is a side view of a plow during reverse plowing, according to another embodiment of the disclosure.

When it is desired to pull snow 410 (e.g., plow or back blade snow 410 in a reverse direction), such as from adjacent an obstacle, e.g., as a garage door or the like, plow 100 is moved in a direction of arrow 500, as shown in FIG. 5, that is opposite to the normal forward-plowing direction indicated by arrow 400 in FIG. 4. In response to moving plow 100 in the direction of arrow 500, back-blade 118 engages snow 410 that is located behind plow 100, as shown in FIG. 5. Resistance due to the presence of snow 410 acts to pivot back-blade 118, in the angular direction indicated by arrow 510, against the biasing force exerted by the one or more springs 140. For example, as back-blade 118 pivots from the forward-plowing blade configuration of FIG. 4, in response to the presence of snow 410, back-blade 118 stretches the one or more springs 140 until the resistance caused by the snow is substantially balanced by the spring forces, at which point pivoting of back-blade 118 stops and plow 100 is in the back-blading configuration of FIG. 5.

Note that for one embodiment, during reverse plowing, back-blade 118 may be angled toward the direction of reverse plowing. For example, during reverse plowing, back-blade 118 may be angled away from lower forward-plowing blade 104 by an angle $\theta_2$, with respect to lower forward-plowing blade 104, in the direction toward the rear of plow 100, as shown in FIG. 5, where angle $\theta_2$ is less than angle $\theta_1$ of FIG. 4. For another embodiment, angle $\theta_2$ may be such that back-blade 118 is substantially vertical.

For one embodiment, as back-blade 118 pivots, edge 119 is contact with surface 412, and back-blade 118 lifts forward-plowing blade 104 off of surface 412, as indicated by arrow 515 in FIG. 5. Pivoting back-blade 118 in contact with surface 412 shifts substantially the entire weight of plow 100 onto back-blade 118, e.g., from lower forward-plowing blade 104.

For example, bottom edge 119 of back-blade 118 that is in contact with surface 412 being plowed applies substantially the entire weight of plow 100 to surface 412 during reverse plowing. This facilitates the substantial removal of "hard-packed" snow and/or ice, for example, during reverse plowing.

Figure 6:
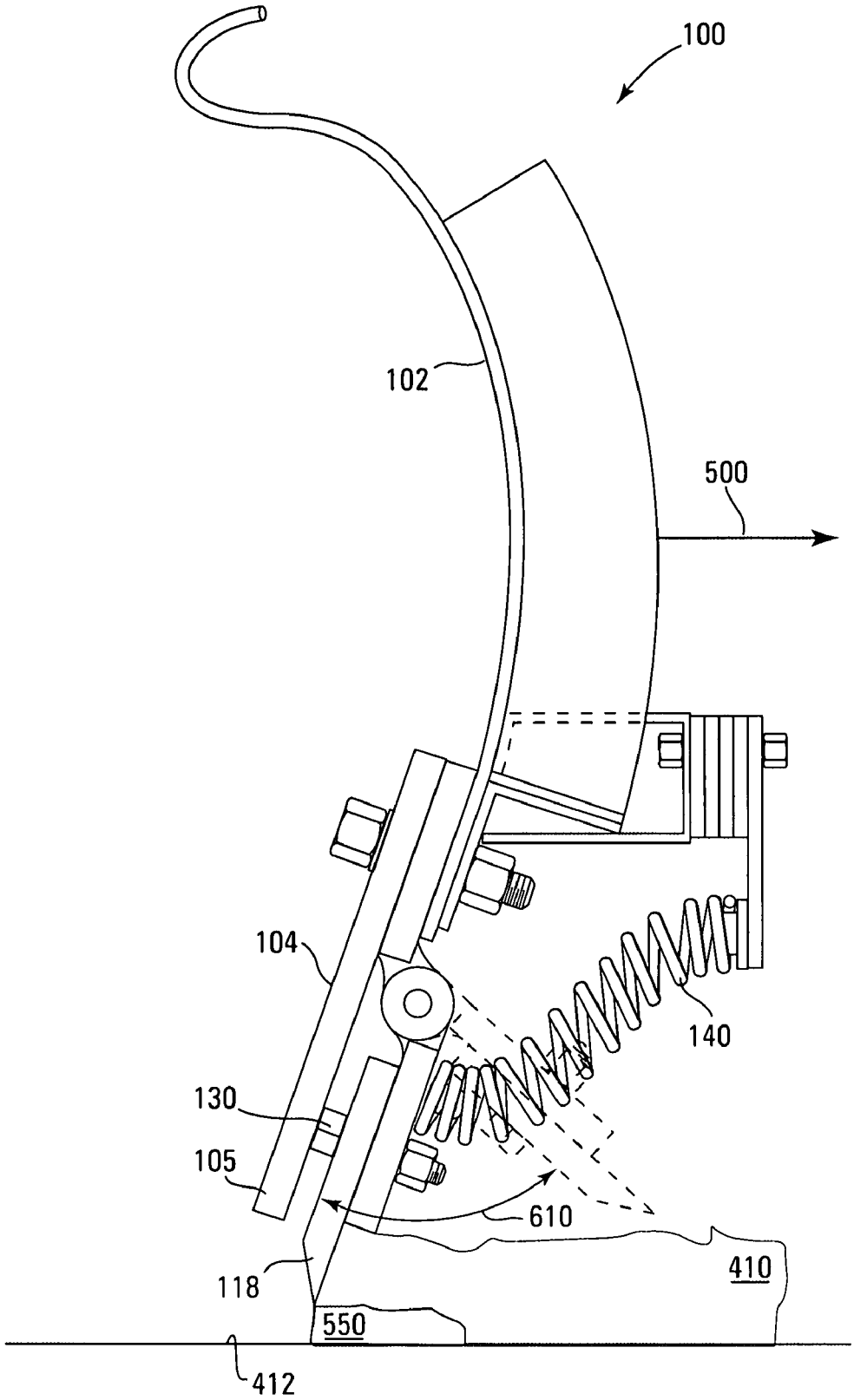
FIG. 6 is a side view of a plow striking an object during reverse plowing, according to another embodiment of the disclosure.

During reverse plowing, it is possible that back-blade 118 could strike a permanent or semi-permanent object 550 (FIG. 5), such as a manhole cover, a curb, a rock, etc., that may be buried under snow 410. For one embodiment, when back-blade 118 strikes an object 550, back-blade 118 pivots, in response to striking object 550, from the back-blading configuration of FIG. 5, in the angular direction indicated by arrow 610 in FIG. 6, against the biasing force exerted by the one or more springs 140 until back blade 118 is angled away from the direction of reverse plowing, as shown in FIG. 6. With back blade 118 in this position, back-blade 118 can slide and move over object 550.

After back-blade 118 moves past the object, the one or more springs 140 return back-blade 118 to the back-blading configuration of FIG. 5 so that back-blade 118 can resume reverse plowing. Note that the elastic coupling between upper blade 102, provided by the one or more springs 140, and back-blade 118, during reverse plowing, enables back-blade 118 to be deflected or "tripped" by object 550 from the back-blading configuration of FIG. 5, where back-blade 118 is angled away from forward-plowing blade 104, to the "tripped" configuration of FIG. 6, where back-blade 118 may be substantially parallel with forward-plowing blade 104, for example, and/or is angled away from the direction of reverse plowing, toward the front of plow 100.

For one embodiment, back-blade 118 may be substantially parallel with forward-plowing blade 104 and/or angled away from the direction of reverse plowing when back-blade 118 stops against the rear portion of forward-plowing blade 104. For example, back-blade 118 may stop against the rear portion of forward-plowing blade 104 when the bolts 130 (FIGS. 1-3) that secure back blade 118 to strap 126 of hinge 122, as described above in conjunction with FIGS. 1-3, engage the rear portion of lower forward-plowing blade 104, as shown in FIG. 6. For other embodiments, back blade 118 stops against the rear portion of forward-plowing blade 104 when back blade 118 pivots into direct contact with the rear portion of forward-plowing blade 104 (not shown).

Note that the operations of plow 100 described in conjunction with the above embodiments, e.g., the pivoting of back-blade 118 to the various positions, are instantly automatic by the motion of the plow. For example, there are no controls, hydraulics, or hand operations required.

CONCLUSION

Although specific embodiments have been illustrated and described herein, it will be appreciated by those of ordinary skill in the art that any arrangement that is calculated to achieve the same purpose may be substituted for the specific embodiments shown. Many adaptations of the embodiments will be apparent to those of ordinary skill in the art. Accordingly, this application is intended to cover any adaptations or variations of the embodiments. It is manifestly intended that the embodiments be limited only by the following claims and equivalents thereof.

What is claimed is:

1. A plow comprising:

an upper blade;

a lower forward-plowing blade coupled to the upper blade, the lower forward-plowing blade configured to engage material to be plowed when the plow is plowing in a forward direction; and a back-blade pivotally coupled to the upper blade and elastically coupled to the upper blade, the back-blade configured to engage material to be plowed when the plow is plowing in a reverse direction opposite the forward direction;

wherein the elastic coupling exerts a biasing force on the back-blade that acts to bias the back-blade in a non-operative position at which the back-blade is pivoted away from the lower forward-plowing blade toward the reverse direction.

2. The plow of claim 1, wherein when the back-blade strikes an object while the plow is plowing in the reverse direction, the back-blade can pivoted by the object against the biasing force of the elastic coupling from a reverse-plowing position to a second position so that the back-blade can move over the object.

3. The plow of claim 2, wherein when the back-blade is in the second position, the back-blade is stopped against the lower forward-plowing blade.

4. The plow of claim 2, wherein the back-blade is angled away from the reverse direction when the back-blade is in the second position.

5. The plow of claim 4, wherein the back-blade is angled away from the lower forward-plowing blade toward the reverse direction when the back-blade is in the reverse-plowing position.

6. The plow of claim 1, wherein the lower forward-plowing blade is fixedly coupled to the upper blade.

7. The plow of claim 1, wherein the plow is configured so that substantially the entire weight of the plow is directed onto the lower forward-plowing blade when the plow is plowing in the forward direction.

8. The plow of claim 1, wherein the plow is configured so that substantially the entire weight of the plow is directed onto the back-blade when the plow is plowing in the reverse direction.

9. The plow of claim 1, wherein the back-blade spans substantially an entire width of the plow.

10. A plow comprising:

an upper blade;

a lower forward-plowing blade coupled to the upper blade, the lower forward-plowing blade configured to engage material to be plowed when the plow is plowing in a forward direction; and a back-blade pivotally coupled to the upper blade and elastically coupled to the upper blade, the back-blade configured to engage material to be plowed when the plow is plowing in a reverse direction opposite the forward direction;

wherein when the plow is plowing in the forward direction the elastic coupling biases the back-blade in a first position;

wherein when the plow is plowing in the reverse direction the back-blade is in a pivoted second position with a biasing force of the elastic coupling acting thereon; and wherein when the back-blade strikes an object while the plow is plowing in reverse, the back-blade is pivoted by the object against the biasing force of the elastic coupling from the second position to a third position in a direction toward the lower forward-plowing blade.

11. The plow of claim 10, wherein when the back-blade is in the first position, the back-blade is angled away from the lower forward-plowing blade toward the reverse direction by a first angle.

12. The plow of claim 11, wherein when the back-blade is in the second position, the back-blade is angled away from the lower forward-plowing blade toward the reverse direction by a second angle that is less than the first angle.

13. The plow of claim 12, wherein when the back-blade is in the third position, the back-blade is angled away from the reverse direction toward the forward direction.

14. The plow of claim 12, wherein when the back-blade is in the third position, the back-blade is substantially parallel to the lower forward-plowing blade.

15. The plow of claim 10, wherein when the back-blade is in the third position, the back-blade is stopped against the lower forward-plowing blade.

16. The plow of claim 10, wherein the plow is configured so that substantially the entire weight of the plow is directed onto the lower forward-plowing blade when the plow is plowing in the forward direction.

17. The plow of claim 10, wherein the plow is configured so that substantially the entire weight of the plow is directed onto the back-blade when the back-blade is in the second position.

18. A method of plowing, comprising:

pivoting a back-blade of a plow to a second position from a non-operative first position against an elastic biasing force in response to moving the back-blade into engagement with material to be plowed when the plow is moved in a direction opposite a normal forward-plowing direction; and plowing the material when the back-blade is in the second position and when the plow is moving in the direction opposite the normal forward-plowing direction;

wherein when the back-blade is in the second position, substantially the entire weight of the plow is directed onto the back-blade; and wherein the elastic biasing force biases the back-blade in the non-operative first position during normal forward plowing with a forward-plowing blade of the plow.

19. The method of claim 18, wherein pivoting the back-blade of the plow to the second position shifts substantially the entire weight of the plow that is directed onto the back-blade when the back-blade is in the second position from a forward-plowing blade of the plow to the back-blade.

20. The method of claim 18 further comprises pivoting the back-blade, against the elastic biasing force, in a direction opposite to which the plow is moving from the second position to a third position when the back-blade strikes an object when the plow is moving in the direction opposite the normal forward-plowing direction.

21. The method of claim 18, wherein pivoting the back-blade of the plow to the second position from the non-operative first position comprises pivoting the back-blade from the non-operative first position in a direction opposite to which the plow is moving.

22. The method of claim 18, wherein pivoting the back-blade of the plow to the second position from the non-operative first position lifts a forward-plowing blade of the plow, used for normal forward plowing, off a surface being plowed.

23. A method of plowing, comprising:

pivoting a back-blade of a plow to a second position from a first position against a biasing force in response to moving the back-blade into engagement with material to be plowed when the plow is moved in a direction opposite a normal forward-plowing direction;

plowing the material when the back-blade is in the second position and when the plow is moving in the direction opposite the normal forward-plowing direction; and pivoting the back-blade from the second position to a third position, against the biasing force, when the back-blade strikes an object when the plow is moving in the direction opposite the normal forward-plowing direction.

24. The method of claim 23, wherein pivoting the back-blade from the second position to a third position further comprises stopping the back-blade against a forward-plowing blade of the plow when the back-blade is at the third position.

25. The method of claim 23 further comprises after the back-blade moves past the object, using the biasing force to pivot the back-blade from the third position back to the second position and resuming plowing the material when the back-blade is back in the second position.

26. The method of claim 24, wherein the back-blade is substantially parallel with the forward-plowing blade when the back-blade is at the third position, the back-blade is angled away from the forward-plowing blade toward the direction opposite the normal forward-plowing direction by a first angle when the back-blade is at the second position, and the back-blade is angled away from the forward-plowing blade toward the direction opposite the normal forward-plowing direction by a second angle that is greater than the first angle when the back-blade is at the first position.

27. The method of claim 26, wherein the back-blade is biased in the first position during normal forward plowing with the forward-plowing blade of the plow.

28. A back-drag-plow system backward compatible with a forward plow as received from a factory, comprising:

a hinge configured to be coupled to the forward plow;

a back-blade coupled to the hinge so that when the hinge is coupled the forward plow, the hinge pivotally couples the back-blade to the forward plow; and a biasing system coupled to the hinge and configured to elastically couple the hinge and thus the back-blade to the forward plow such that the elastic coupling exerts a biasing force on the back-blade that acts to bias the back-blade in a non-operative position at which the back-blade is pivoted away from a forward-plowing blade of the forward plow.

29. The back-drag-plow system of claim 28, wherein the hinge is configured to be coupled to the forward plow by bolting using existing bolt holes in the forward plow.

30. The back-drag-plow system of claim 28, wherein the forward-plowing blade is a lower forward-plowing blade and wherein the hinge is configured to be coupled interposed between the lower forward-plowing blade and an upper blade of the forward plow by bolting using existing bolt holes in the upper blade and in the lower forward-plowing blade.

31. A method of configuring a forward plow, as received from a factory, for plowing in reverse, the method comprising:

bolting a hinge of a back-drag system to the forward plow using existing bolt holes in the forward plow to pivotally couple a back-blade coupled to the hinge to the forward plow; and coupling a biasing system of the back-drag system to the forward plow to elastically couple the hinge and thus the back-blade to the forward plow such that the elastic coupling exerts a biasing force on the back-blade that acts to bias the back-blade in a non-operative position at which the back-blade is pivoted away from a lower forward-plowing blade of the forward plow.

32. The method of claim 31, wherein bolting the hinge of the back-drag system to the forward plow using existing bolt holes in the forward plow further comprises:

interposing a portion of the hinge between an upper blade of the forward plow and the lower forward-plowing blade of the forward plow; and bolting the portion of the hinge to the forward plow using existing bolt holes in the upper blade of the forward plow and in the lower forward-plowing blade of the forward plow.

* * * * *